US011287184B2

(12) United States Patent
Brynildsen et al.

(10) Patent No.: US 11,287,184 B2
(45) Date of Patent: Mar. 29, 2022

(54) APPARATUS AND METHOD FOR DRYING AND/OR CURING OF MATERIALS

(71) Applicant: Kebony AS, Oslo (NO)

(72) Inventors: Per Brynildsen, Oslo (NO); Karl Christian Kristiansen, Stathelle (NO)

(73) Assignee: Kebony AS, Oslo (NO)

( * ) Notice: Subject to any disclaimer, the term of this patent is extended or adjusted under 35 U.S.C. 154(b) by 124 days.

(21) Appl. No.: 16/614,380

(22) PCT Filed: May 16, 2018

(86) PCT No.: PCT/EP2018/062791
§ 371 (c)(1),
(2) Date: Nov. 18, 2019

(87) PCT Pub. No.: WO2018/215267
PCT Pub. Date: Nov. 29, 2018

(65) Prior Publication Data

US 2020/0080774 A1 Mar. 12, 2020

(30) Foreign Application Priority Data

May 22, 2017 (EP) ..... 17172243

(51) Int. Cl.
*F26B 5/04* (2006.01)
*F26B 3/06* (2006.01)
(Continued)

(52) U.S. Cl.
CPC ..... *F26B 3/06* (2013.01); *F26B 9/06* (2013.01); *F26B 21/02* (2013.01); *F26B 25/008* (2013.01); *F26B 25/10* (2013.01); *F26B 2210/16* (2013.01)

(58) Field of Classification Search
CPC .... F26B 3/06; F26B 9/06; F26B 21/02; F26B 25/008; F26B 25/10; F26B 2210/16
(Continued)

(56) References Cited

U.S. PATENT DOCUMENTS 1,976,410 A * 10/1934 Oakleaf ..... F26B 9/06 34/212
5,226,244 A * 7/1993 Carter ..... F26B 21/026 34/191
(Continued)

FOREIGN PATENT DOCUMENTS

| | | |
|---|---|---|
| EP | 1118828 | 7/2001 |
| FR | 894750 | 1/1945 |
| JP | S54107505 | 8/1979 |

OTHER PUBLICATIONS

EPO Comminication 94(3) dated Dec. 10, 2020, submitted inter alia as a statement of relevance for non-English references cited and discussed therein, including references submitted in the present IDS and IDS of Nov. 8, 2019.

*Primary Examiner* — John P McCormack
(74) *Attorney, Agent, or Firm* — Christian D. Abel

(57) ABSTRACT

The invention involves an apparatus and a method for drying and/or curing impregnated wood. The apparatus includes a chamber comprising a stack containing space for containing a plurality of elongated wood planks arranged in a stack of a height $H_s$, width $W_s$ and length $L_s$, a heating element arranged within or adjacent to the space, a flow generating device arranged outside the space and configured to generate a circulating flow (F) of curing fluid within the chamber and a fluid flow restrictor arranged between the space and the flow generating device. The flow generating device and the fluid flow restrictor are further configured such that the circulating flow (F) of curing fluid is guided through the heating element generating a homogeneously heated and
(Continued)

distributed flow (F) of curing fluid in the space. At least one motor is arranged outside the chamber, the at least one motor being configured to operate the flow generating device via a connecting shaft.

23 Claims, 5 Drawing Sheets

(51) Int. Cl.

| | |
|---|---|
| ***F26B 9/06*** | (2006.01) |
| ***F26B 21/02*** | (2006.01) |
| ***F26B 25/00*** | (2006.01) |
| ***F26B 25/10*** | (2006.01) |

(58) Field of Classification Search
USPC ..... 34/417, 467, 476, 477, 507, 60, 69
See application file for complete search history.

(56) References Cited

U.S. PATENT DOCUMENTS

| | | | | |
|---|---|---|---|---|
| 5,269,076 | A * | 12/1993 | Breckenridge | F26B 21/02 34/191 |
| 2011/0271546 | A1* | 11/2011 | Eriksen | F26B 23/10 34/408 |
| 2012/0101620 | A1 | 4/2012 | Bendiksen et al. | |
| 2016/0018160 | A1* | 1/2016 | Wingate, Jr | F26B 25/00 417/53 |
| 2017/0120267 | A1* | 5/2017 | Ackerman | B01J 2/16 |

* cited by examiner

APPARATUS AND METHOD FOR DRYING AND/OR CURING OF MATERIALS

TECHNICAL FIELD

The present invention relates to dryers, in particularly the present invention relates to dryers for drying wood and/or dryers for curing wood that has been formerly impregnated with polymerizable chemicals.

BACKGROUND OF THE INVENTION

Traditional dryers/drying kilns for wood normally comprise a chamber wherein planks of wood is placed in a stack and heated and dried by a warm circulating airflow. This airflow is generated from fans and passed through a heating battery creating a warm airflow to dry the wood. The water that evaporates from the wood is removed from the chamber as a wet warm airflow through an outlet channel.

WO 2011/144608 A1 and WO 2010/116262 A1 disclose a stack of wood to be impregnated by impregnating material comprising an aqueous monomer or oligomer composition. The wood is exposed to the impregnating material inside an autoclave and involve vacuum treatment and/or treatment under pressure. The wood is thereafter subjected to a water removal process (drying), preferably followed by a polymerization process (curing) in an apparatus like a traditional drying kiln, in order to produce the impregnated wood.

U.S. Pat. No. 1,976,410 A discloses a drying apparatus for wood providing a light frame structure that wood can easily and quickly be placed in and out from in a large volume. The drying apparatus is having a fixed central air unit housing comprising a fan, and two end-sections. The end-sections are separated from the housing by receiving chambers for wood. The fans are arranged in a central partition dividing the central air unit housing in two, where heating elements are arranged on both sides of the central partition.

U.S. Pat. No. 5,226,244 A also discloses a drying apparatus for wood. The apparatus comprises a stack containing space, a fan placed above a horizontal platform and heating elements arranged within the stack containing space.

One of the disadvantages by the processes and apparatus known from prior art is that the final materials are not uniformly dried, independent of materials position inside the chamber. Further, the drying and/or curing process time is long caused by insufficient and/or non-uniform distribution of fluid flow during the drying process, which also results in the product having an uneven amount of water. During drying of wood, resins from the wood have a tendency to be deposited on equipment surfaces. Further, the wood comprises volatile organic chemicals (VOCs) that attack lubricants on the moveable elements in the apparatus, thereby spoiling the lubrication of movable or rotating elements. The same problems take place during curing since the impregnated wood comprises a monomer or oligomer solution where polymerizable components may escape to the gas phase and polymerise on equipment surfaces. The VOCs developed during polymerization also tend to contaminate or degrade lubricants on elements inside the apparatus. The formation of VOCs during drying and/or curing tend to degrade lubricants on for example the rotating equipment of the fan, thereby increasing the need for maintenance. Heating elements are especially vulnerable to resins and polymer deposits since their hot surfaces will facilitate rapid polymerisation of polymerizable low molecular components in the gas phase.

Due to the production of VOCs in the apparatus during both drying and curing, there is a risk of explosion within the apparatus. An object of the present invention is therefor to provide an apparatus reducing or preferably avoiding the possibility of explosion within the chamber of the apparatus.

Further, there is an object of the present invention is to provide an apparatus and process which reduces the need for cleaning and maintenance of the apparatus, thereby increasing the overall operational availability of the equipment.

Another object of the present invention is to obtain close to equal conditions for the material, such as planks of wood, independently of their positions within the stack, and thereby providing a dried and/or cured material where the water content and/or polymerization of the final product is uniform, or close to uniform, independent of the material's location in the processed stacks of material.

Another object of the present invention is to provide an apparatus and process which reduces the need for cleaning and maintenance of the apparatus, thereby increasing the overall operational availability of the equipment. Yet another object of the invention is to protect the shaft(s) of the motor(s) of the flow generating device(s) from the VOC contaminated atmosphere inside the apparatus.

SUMMARY OF THE INVENTION

The present invention is set forth and characterized by the independent claims while the dependent claims describe other characteristics of the invention.

In particular, the present invention relates to an apparatus and process for drying planks of wood and/or curing impregnated planks of wood overcoming the disadvantages known from prior art.

The invention is especially applicable to drying and/or curing woods sensitive to cracking and/or deformation to produce impregnated wood which comprises inter alia increased strength, resistance to water, moisture and chemicals, and has a reduced possibility of cracking.

Wooden planks to be dried comprises resins and VOCs that are removed from the planks during drying and tend to attack the equipment of the apparatus in different ways as described above. These problems become even greater when the wood has been formerly saturated or dosed with an amount of suitable oligomer/monomer to produce impregnated wood, in that the amount of VOCs increases and the elements in the apparatus are subjected to both resins from the wood and polymer growth on the equipment. There is thus a need for an apparatus that reduces the frequency of need for maintenance.

Further, during both the drying and curing process an amount of bottom condensate/deposits is created, released by water, resins, the impregnation material and the like. Some of the bottom condensate such as resins and impregnations material has the tendency to stick to the bottom, thus there is a need of continuous removal of the bottom condensate before it attaches itself to the floor.

Hereinafter a plank or elongated plank is to be understood as geometrical shape having substantially rectangular shape with substantially parallel faces. The planks have a length, width and height, where the length extends longer than the width and height. In the examples herein, the width of the planks are longer than the height.

The apparatus of the present invention provides a final product of dried wooden planks comprising an evenly distributed amount of water after drying within each plank and independently of their position in the stack, meaning that all the planks have the same, or close to the same water content.

Further, if the planks are formerly saturated with an impregnation material, the final product obtained comprises evenly impregnated planks of wood independently on their position in the stack.

The apparatus of the present invention comprises a chamber comprising:

- a stack containing space for containing a plurality of elongated wood planks arranged in a stack of a height $H_s$, width $W_s$ and length $L_s$,
- a heating element arranged within or adjacent to the stack containing space, wherein the size and orientation of the heating element is configured such that the heating element extends along the height $H_s$ and the length $L_s$ of the stack's surface area when the stack has been inserted into the stack containing space,
- a flow generating device arranged outside the stack containing space and configured to generate a circulating flow of curing fluid within the chamber and
- a fluid flow restrictor arranged between the stack containing space and the flow generating device, wherein the flow generating device and the fluid flow restrictor are configured such that the circulating flow of curing fluid is guided through the heating element, generating a homogeneously heated and distributed flow of curing fluid in the stack containing space, and wherein the apparatus further comprises at least one motor arranged outside the chamber, the at least one motor being configured to operate the flow generating device via a connecting shaft.

The stack containing space is where the stack(s) of wood are arranged during drying and/or curing. The space can be square or rectangular depending on the height of the stack of elongated wooden planks.

A stack of elongated wooden planks should be interpreted as one or a plurality of partial stacks arranged adjacent to each other. The plurality of partial stacks may have a distance (gap) between them when placed inside the stack containing space.

The stack's surface area should be interpreted as the maximum surface area extending over the entire height $H_s$ and length $L_s$, or height $H_s$ and width $W_s$ or length $L_s$ and width $W_s$ of the stack. If the stack comprises a plurality of said partial stacks, the above-mentioned gap(s) between the partial stacks is included in the surface area.

The fluid flow restrictor is in an advantageous embodiment having a size and orientation extending over the surface area of the in the stack's length $L_s$ and width $W_s$ and/or height $H_s$ and width $W_s$, when a stack is installed within the stack containing space. The fluid flow restrictor will in a preferred embodiment extend over the entire said surface area of the stack to guide the flow of curing fluid through the heating elements. The fluid flow restrictor may extend over at least the entire surface area of the stack, however without blocking the circulating curing fluid to be guided through the heating element.

The fluid flow restrictor can be made of steel, aluminium or any kind of material resistant to the atmosphere inside the apparatus and which prevents the curing fluid from passing therethrough.

The fluid flow restrictor is preferably placed as close to the stack as possible to minimize or avoid the formation of fluid pockets between the planks and the fluid flow restrictor that may cause the fluid flow to short-circuit. Such a short-circuit may hinder homogeneous distribution of curing fluid flow within the stack containing space. The fluid flow restrictor is preferably arranged between 0.1 and 50 cm from the stack, more preferably between 0.3 and 20 cm from the stack, or even more preferably between 0.5 and 5 cm from the stack during use of the apparatus.

The flow generating device can be any kind of device producing a fluid flow such as a fan or an injector. Preferably, the flow generating device can alternate the direction of the flow of the curing fluid during operation of the apparatus.

The control of the operation of the flow generating device can be regulated by a controller. Such regulation is highly preferred because resistance to rotation varies with the changing pressure inside the chamber and there is a desire to control overall curing fluid flow velocity, direction and related convection effects.

Due to the production of VOCs in the apparatus during both drying and curing, there is a risk of explosion within the apparatus. To avoid the possibility of explosion, the motor of the flow generating device is arranged outside the chamber. The motor is configured to operate the flow generating device via a connecting shaft, and may for example be electrically driven.

In another embodiment of the invention, the flow generating device is arranged within or adjacent to at least one fluid flow preventing wall, the at least one wall being configured to guide the curing fluid fully through the flow generating device. For example, at least one fluid flow preventing wall may be sealingly attached at its outer rim to the inner chamber wall and the fluid flow restrictor, while the flow generating device is inserted into an inner channel of the fluid preventing wall.

Preferably, a plurality of flow generating devices are arranged and evenly distributed within the fluid flow preventing wall.

In another embodiment, the chamber of the apparatus comprises at least two heating elements, wherein at least two heating elements are arranged on the opposite sides of the stack and extending along at least the height $H_s$ and the length $L_s$ of the stack's surface area when the stack has been inserted into the stack containing space. Such arrangement further ensures a homogenously heated and distributed flow of fluid.

In another embodiment, the chamber comprises at least three heating elements, wherein at least two of the at least three heating elements are arranged on the opposite side of the stack extending along at least the height $H_s$ and the length $L_s$ of the stack's surface area when the stack has been inserted into the stack containing space, and at least one of the at least three heating elements is arranged in between the at least two opposite arranged heating elements.

For example, when the stack comprises two partial stacks arranged adjacent to each other in the direction of the width, two heating elements can be arranged on opposite sides of the stack and extend along the height $H_s$ and length $L_s$ of the stack, while the third heating element can be arranged in the gap between the two partial stacks, also extending along the height $H_s$ and width $W_s$ of the stack. It is also possible to place several heating elements parallel to each other within the stack comprising a plurality of partial stacks.

In another embodiment, the heating element comprises a plurality of interconnected pipes for flow of heating element fluid therethrough, wherein the plurality of pipes are spaced apart, thereby forming a plurality of slits into which the circulating flow of curing fluid may pass through during operation.

The heating element fluid, for example hot steam, is guided inside the pipes from an external inlet to an external outlet channel, wherein the pipes are configured to transfer heat to the curing fluid. By controlling the temperature of the heating element fluid inside the pipes, the temperature of the curing fluid passing therethrough can be controlled.

The function of the heating elements is to contribute to both a homogeneously heated and a homogeneously distributed flow of curing fluid within the stack containing space. If the heating element comprises a plurality of pipes having slits between them, the pipes and slits are preferably covering the entire surface area extending along the height $H_s$ and the length $L_s$ of the stack thus forcing all the curing fluid to pass through the plurality of slits/openings between the pipes of the heating element. Further, the slits are preferably of the same size and evenly distributed within the heating element.

The pipes of the heating elements can be made of any material having high thermal conductivity, such as for example steel or copper, able to heat the curing fluid up to at least 150° C.

Further, the heating element is preferably arranged as close to the material to be dried as possible to minimize or avoid the formation of fluid pockets that may cause the fluid flow to short-circuit and thereby not distribute evenly within the stack containing space. In a preferred embodiment, the heating elements are arranged between 0.1 and 50 cm from the stack, more preferably between 0.3 and 20 cm from the stack, or even more preferably between 0.5 and 5 cm from the stack during use of the apparatus.

In another embodiment, the elongated wood planks, when installed within the stack containing space, are being separated in height by spacer elements, thereby allowing the flow of curing fluid to circulate between the stacked layers of planks.

In another embodiment, the chamber comprises a chamber floor at or adjacent to a base of the space intended to support the stack. The chamber floor has a gradient allowing continuous drainage of deposits/condensate originating from the wood in the stack during operation. The gradient chamber floor may allow the deposits/condensate that is created during drying and/or curing to be collected and drained/withdrawn from the chamber through an outlet port in or adjacent to the gradient chamber floor. The outlet port may further be equipped with for example a pump to facilitate the continuous draining of deposits/condensate.

During drying and/or curing the condensate is preferably quickly removed from the chamber to avoid adhesiveness of the condensate before removal.

The stack of wooden planks arranged in the stack containing space is thus preferably arranged on supporting elements keeping the stack horizontal and at distance above the gradient floor during drying and/or curing. Preferably, the supporting elements are configured to guide the fluid flow through the slits of the heating element.

Further, the shaft may comprise movable elements connecting the shaft to the flow generating device. In order to protect the shaft and its moveable elements from the atmosphere inside the chamber, the part of the shaft contained within the chamber is in an another embodiment of the invention arranged within an enclosing tube that, during operation of the apparatus, contains an inert gas.

In another embodiment, the enclosing tube is at a first end connected to the wall of the chamber and a second end arranged adjacent to the flow generating device. The first end encloses in this embodiment at least one inert gas inlet allowing inlet of inert gas from outside the chamber into the enclosing tube. The second end has at least one outlet penetrating its enclosing tube wall, allowing outlet of inert gas through the enclosing tube. A continuous flow of inert gas is thereby passing through the enclosing tube during operation and hindering inter alia resins, polymers and VOCs from entering into the tube, thereby avoiding any attacks or deposits thereof inside the tube, thus reducing the need for maintenance thereof. The inert gas may for example be nitrogen or argon gas.

The resins from the wood and excess of polymer that is created during drying and/or curing tend to attack elements inside the chamber by forming a resin and/or polymer layer on their surface. Such layers formed on the heating elements cause disruption of the flow pattern of curing fluid through the slits, since the size of the slits are being reduced. Further, the layer causes reduction in heat transfer to the curing fluid and thereby affects the controlling of the temperature of the curing fluid.

These problems can be solved by the present invention by manufacturing the heating elements by a plurality of interconnected horizontal and vertical pipes for flow of heating element fluid therethrough, wherein at least two horizontal pipes are spaced apart by a plurality of vertical pipes forming a plurality of slits into which the flow of curing fluid may pass through during operation. The number of vertical pipes may advantageously exceed the number of horizontal pipes by a factor of at least 2, more preferably by a factor of at least 4, even more preferably of a factor of at least 8, and even more preferably of a factor of at least 9, for example a factor of 10. The number of vertical pipes will depend on the length of the stack placed inside the apparatus. It is an advantage to have an excess of vertical pipes since horizontal pipes are more subjected to vertical growth of resin and/or polymer layers. Further, layers of resin and/or polymers growing on vertical pipes may flake off and fall to the base of the chamber due to gravity forces.

In another embodiment of the invention the plurality of vertical pipes are preferably equally or near equally spaced apart, and the plurality of horizontal pipes are equally or near equally spaced apart, creating slits having a uniform or close to uniform shape and size to obtain a uniform fluid flow.

In an exemplary embodiment, the heating element comprises two horizontal longitudinal pipes separated by a plurality of equally spaced vertical longitudinal pipes forming a plurality of slits into which the flow of curing fluid passes through.

In another embodiment, the pipes are straight to allow the layers of resins and/or polymers to flake off and fall to the base of the chamber during drying and/or curing.

The term "straight" is used to describe the geometry of the hollow longitudinal pipes. By straight is meant that the pipes do not comprise fins, arms, pits or arcs which can cause the layer if resins or polymers to grow in a vertical direction. Such vertical growth reduces the likelihood of the resins or polymers to flake off due to gravity forces, making them hard to remove during cleaning/maintenance.

In another embodiment, the vertical and horizontal longitudinal pipes have a smooth surface thereby reducing or removing the risk for the resins or polymerized material to attach to the surface of pipes. Also, the smooth surface increases the possibility of the resins or polymers to flake off and makes any attached resins or polymers easy to remove by cleaning.

The term "smooth" is used herein to describe a surface that is even and regular and possibly polished.

The resins and polymerized material can flake off due to the difference in the coefficient of thermal expansion between the heating element and the resins or polymerized material. Thermal cycling of the heating element can cause the resins and polymerized material to crack and flake off the pipes of the heating elements. The resins and polymers will then precipitate to the base of the chamber. If the resins or polymers do not flake off, the surface will still be easier to clean by for example high pressurized water or the like, due to the fact that the elements are straight and have a smooth surface.

The pipe arrangement of the heating element described above also provides a large surface area of the heating elements, providing a homogeneously heated fluid flow, and further provides a relatively high pressure loss to the flow of curing fluid when entering the slits, thus causing the flow of curing fluid to drop to an equal pressure before entering the slits. A homogeneously distributed fluid flow inside the stack containing space is thereby obtained.

During drying and/or curing when liquid vaporizes and expands, a part of the curing fluid leaves the chamber through a fluid outlet chamber due to slight increase in pressure inside the chamber compared to the other end of the fluid flow outlet channel. The outlet channel may guide the hot fluid flow out from the chamber to a condenser situated outside the chamber, in where condensable parts of the curing fluid can be recovered for reuse and reduction of general VOC-emissions of the process. The amount of water leaving the chamber can e.g. be measured by measuring the velocity of the flow passing through the outlet channel, thus a controlled drying and/or curing process can be obtained.

In another embodiment, the apparatus comprises a device for detecting the oxygen level of the atmosphere inside the chamber during use. Such detection can be important to reduce the risk of VOCs to react with oxygen which may cause an explosion inside the chamber.

In another embodiment, the chamber comprises an inlet channel for feeding an inert gas into the chamber when needed, i.e. when the oxygen level inside the chamber is too high. By too high is meant that there is a risk of oxygen reacting with VOCs, causing an explosion inside the chamber.

Further the apparatus may comprise a monitoring subsystem and a process controller coupled to the chamber as disclosed in WO2010/116262 A1.

The apparatus of the present invention is preferably rectangular. It may however be of any square-shape or cylindrical.

The present invention also concerns a method for drying wood and/or curing impregnated wood in an apparatus as described above, for obtaining a homogeneously heated and distributed flow of curing fluid within the stack containing space.

The method comprises the following steps:

a) inserting the stack of wood planks inside the stack containing space of the chamber,
b) sealing/closing the chamber,
c) activating the flow generating device for producing a circulating flow of curing fluid inside the chamber and
d) forcing the circulating flow of curing fluid to pass through the heating element.

In another embodiment the chamber is prior to step c) flushed with an inert gas to remove oxygen from the atmosphere inside the chamber, in order to avoid any risk of explosion inside the chamber during operation.

Further, the method may comprise the step of continuously draining deposits/condensate originating from the wooden planks during operation through at least one drain port.

The heating elements are preferably heating the curing fluid to at least 50° C. when the purpose is to dry wood. Preferably the temperature is at least 100° C.

If the purpose of the process is to make cured impregnated wood, then the wood must be saturated or dosed with an impregnation solution prior to step a). During curing the temperature of curing fluid is preferably above 100° C. to cause polymerization of the impregnation solution comprising monomers/oligomers. Preferably the temperature is from 110° C. to 130° C.

The present invention also concerns the use of the apparatus for drying and curing impregnated wood.

The present invention also concerns the use of the apparatus curing impregnated wood.

The term "curing fluid" should be understood as a drying and/or curing medium such as for example steam or an inert gas.

The term "monomer/oligomer" includes compounds, solutions, mixtures and condensation products of monomers and oligomers that produce polymer treated wooden products, such as furfurylated wood products, including furfuryl alcohol, bishydroxy methyl furan, trihydroxy methyl furan, oligomers and condensate products of these compounds and mixtures thereof.

In the following description, numerous specific details are introduced to provide a thorough understanding of embodiments of the claimed apparatus and method. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

Figure 1:
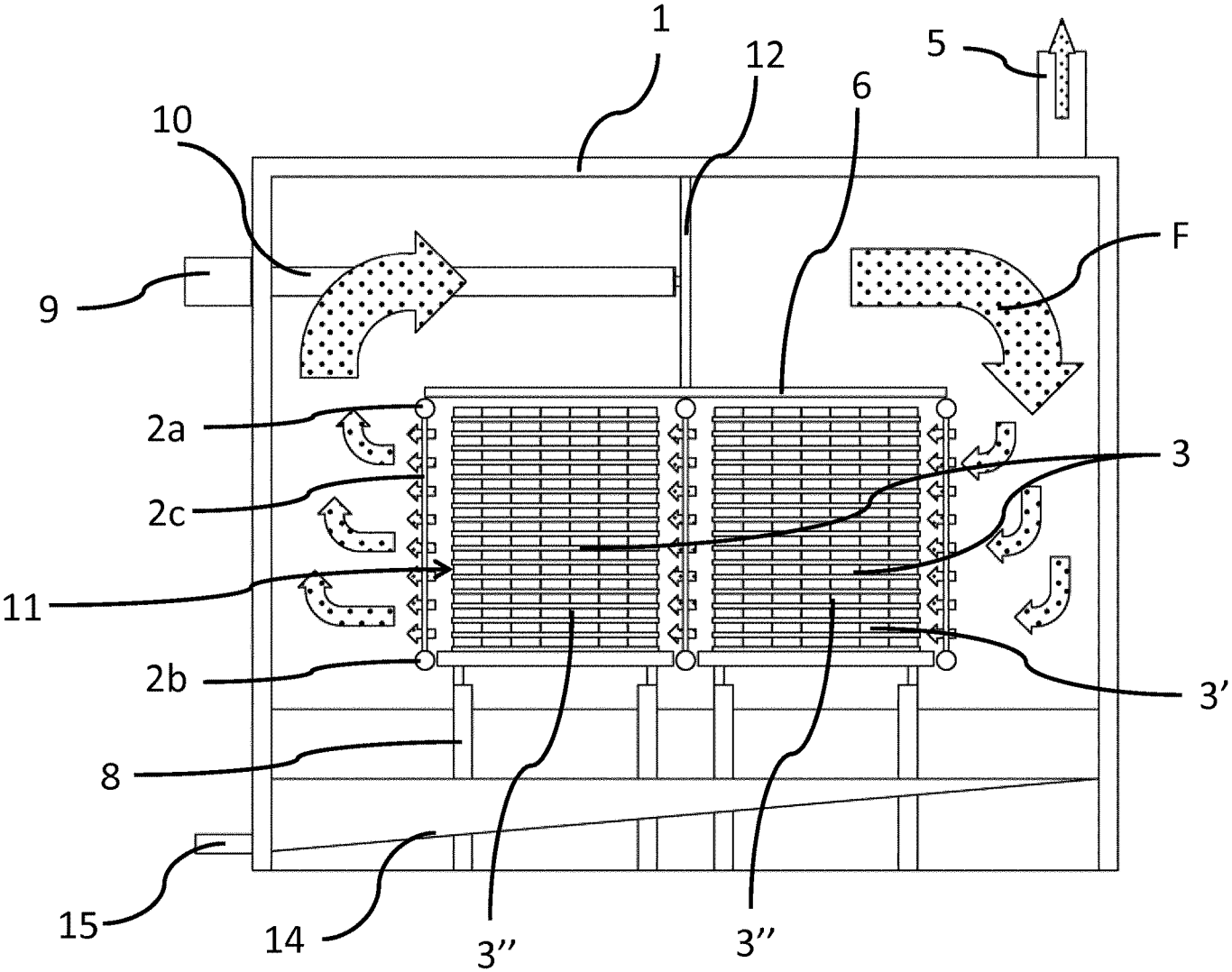
FIG. 1 shows a cross-sectional front view of an apparatus according to the present invention.

In the drawings, equal reference numbers refer to equal equipment.

DETAILED DESCRIPTION OF THE INVENTION

FIG. 1 to 4 shows an open apparatus according to one exemplary embodiment of the invention comprising a chamber 1 for drying and/or curing a stack 3 comprising two partial stacks 3" of elongated planks 3'. The planks 3' to be dried can formerly be saturated, impregnated or dosed with an impregnation solution of a polymerizable monomer or oligomer, thus the wood can be cured in the same apparatus.

In terms of general operation, the chamber 1 comprises a least one door (not shown) to pass the stack 3 of partial stacks 3" of elongated planks 3' in and out of the chamber 1. The door is closed in a sealed manner during the drying and/or curing process of the planks 3'.

Figure 3:
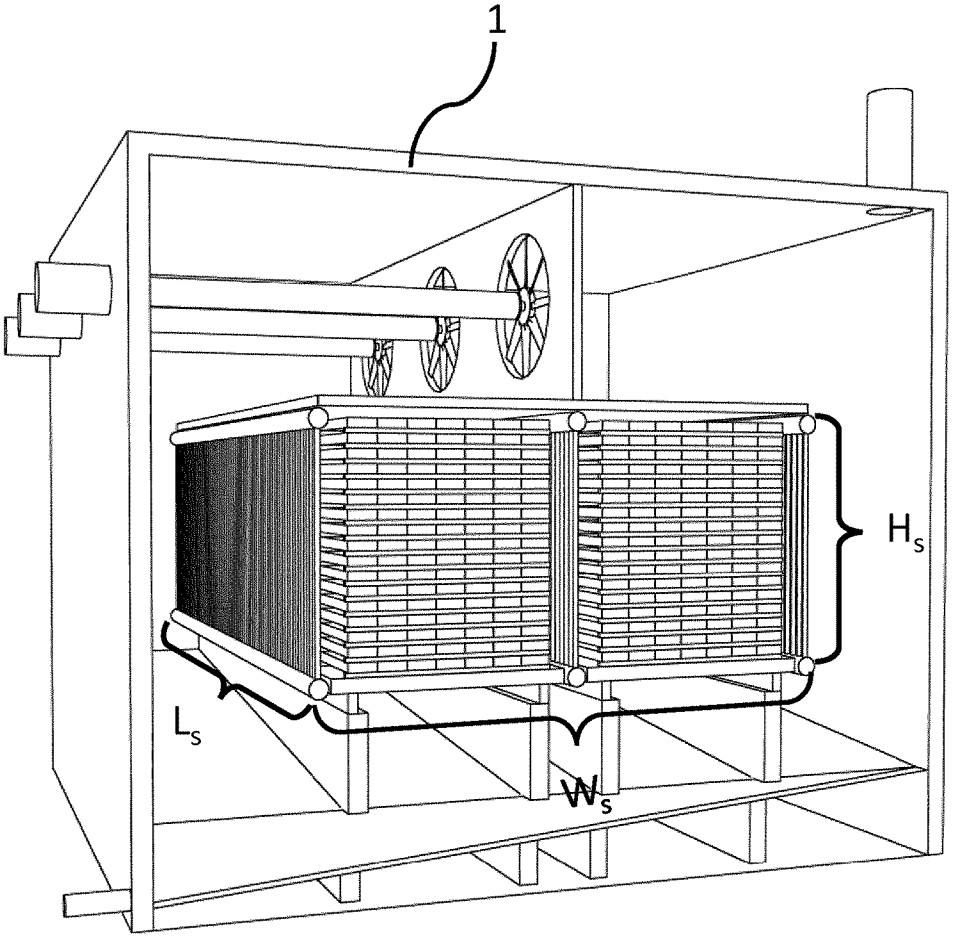
FIG. 3 shows the same as FIG. 2.
Figure 4:
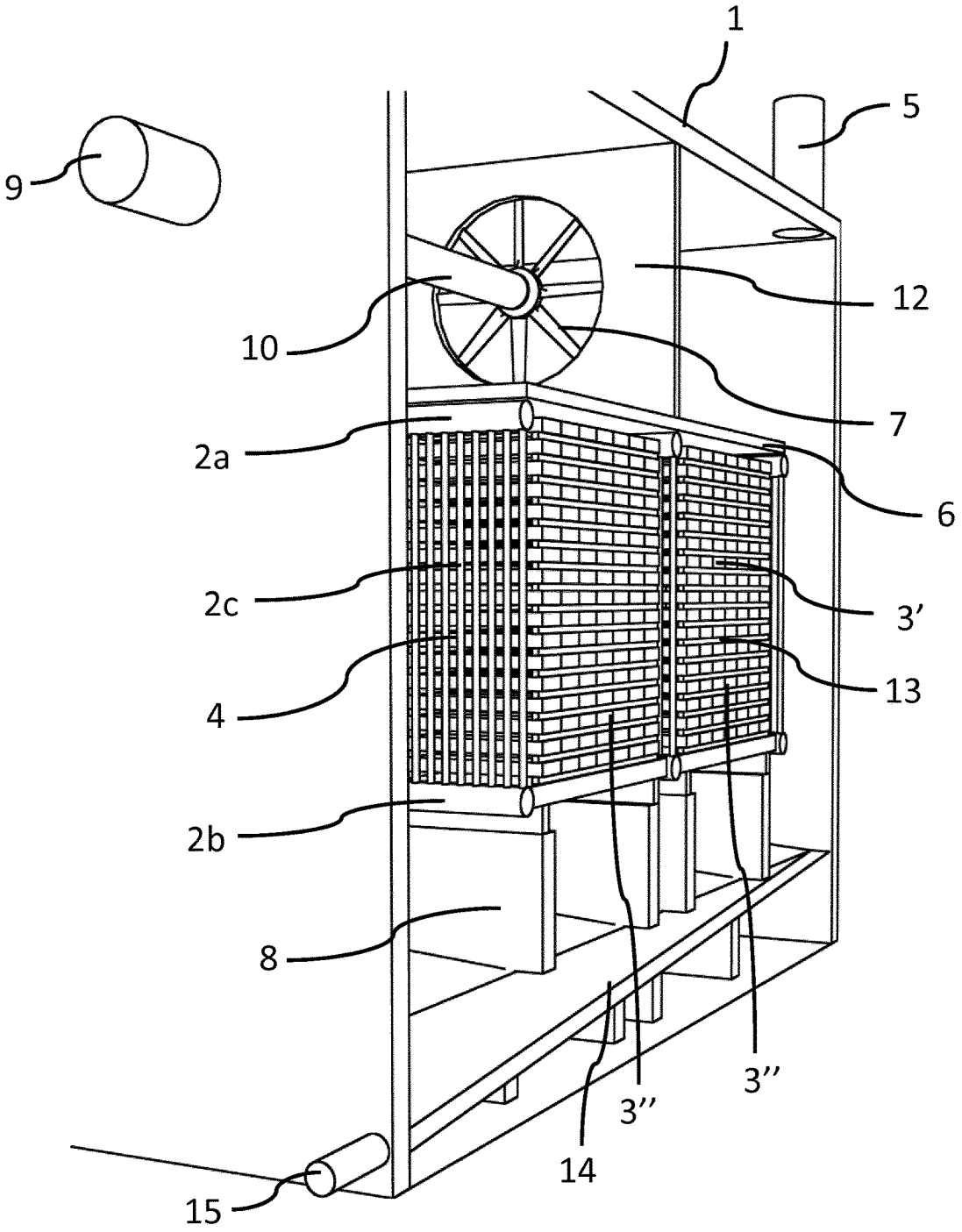
FIG. 4 shows a perspective side view of an open apparatus according to the present invention.

The chamber 1 displays a stack containing space 11 having a stack 3 of two partial stacks 3" of planks 3' in a height $H_s$ (see FIG. 3). As illustrated the partial stacks 3" of elongated planks 3' are arranged adjacent to each other.

Figure 2:
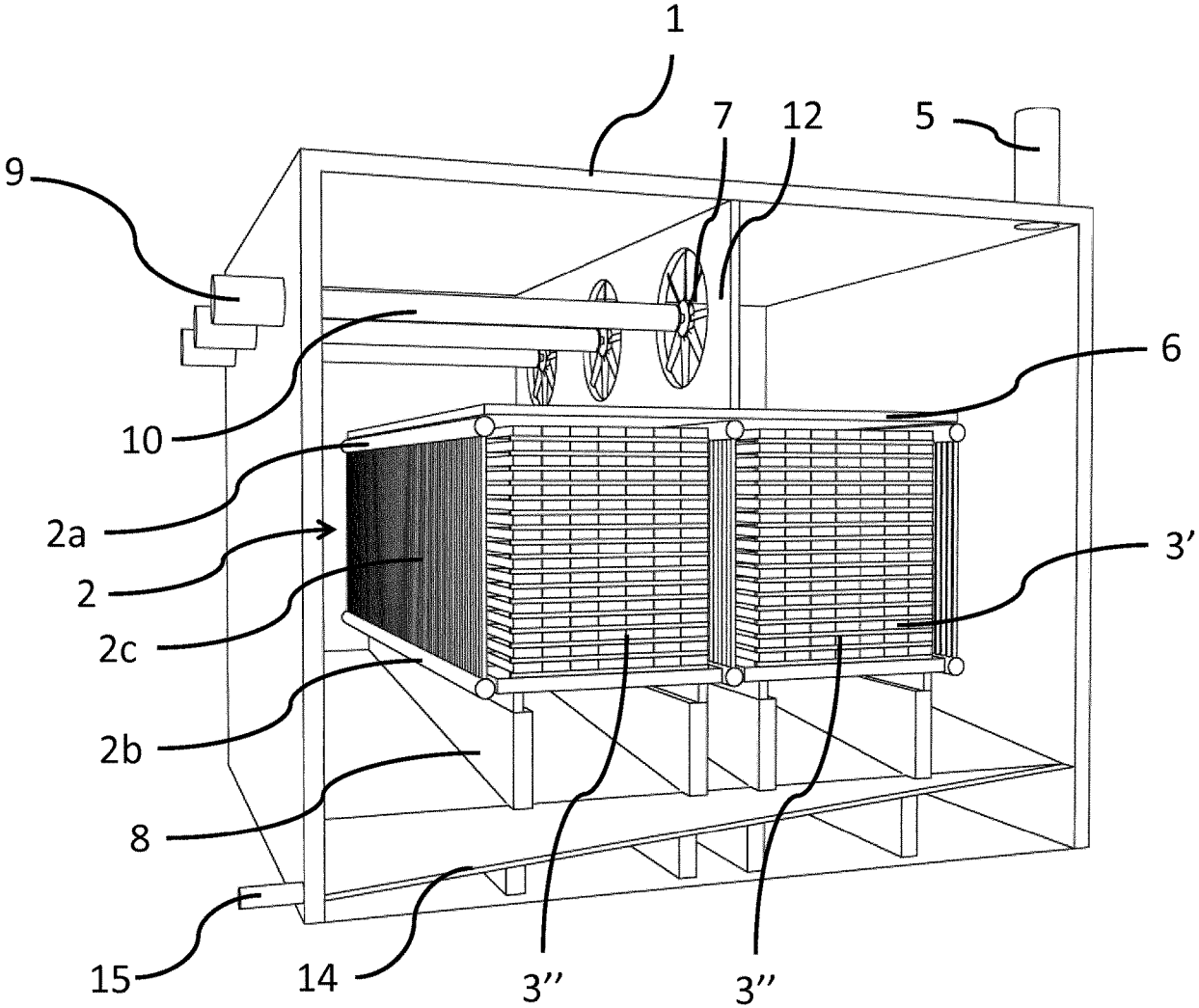
FIG. 2 shows a perspective three-dimensional view of an open apparatus according to the present invention.

Further, as can be seen in FIGS. 2 and 3, a plurality of fans 7 are arranged on top of the stack containing space 11, but may in another arrangement be arranged in front, back and/or underneath/below the stack containing space 11.

The plurality of fans 7 are arranged inside openings of a wall 12.

During drying and/or curing so-called "top condensate" is created comprising inter alia steam from water and volatile organic chemicals (VOC). To avoid the possibility of explosion, the fan(s) 7 are connected to electric motor(s) 9 arranged outside the chamber 1 via rotating shaft(s). The shaft(s) are arranged in protective tube(s) 10 comprising an inert gas that is led through the tube 10 from an inlet from the outside of the chamber 1 to an outlet penetrating through the tube 10 at or adjacent to the flow generating device 7.

The operation of the fan motor(s) 9 can be regulated by controller(s) (not shown) regulating the speed and/or direction of the flow (F) of curing fluid within the chamber 1.

A fluid flow restrictor 6 is arranged between the stack containing space 11 and the fan 7 prohibiting the flow (F) of curing fluid to pass therethrough, thereby guiding the flow (F) of curing fluid through the heating elements 2.

To establish a homogenous flow (F) of curing fluid inside the stack containing space 11, the fluid flow restrictor 6 is arranged as closely as possible to the stack 3 or partial stack 3". Further, each heating element 2 has two horizontal longitudinal pipes 2*a,b* separated by a plurality of equally spaced vertical longitudinal pipes 2*c* forming a plurality of slits 4 (see FIG. 4), wherein the flow (F) of curing fluid passes through the slits 4. As can be seen from FIG. 1 to 4 the chamber 1 comprises three heating elements 2 arranged on each side of the partial stacks 3" along the height $H_s$ and length $L_s$ of the stack 3. The vertical and horizontal longitudinal pipes can be hollow and in fluid communication with each other allowing heating element fluid to pass therein.

Further it is shown in FIG. 1 to 4 that the partial stacks 3" in the stack 3 are arranged on top of support elements 8. The support elements 8 are creating a space between the stack 3 and the gradient floor 14 of the chamber 1, thus allowing condensate which is produced during drying and/or curing to precipitate to the gradient floor 14 and subsequently be removed through a drain port 15.

Further the support elements 8 are arranged to enclose a volume underneath the stacked materials thereby guiding the flow (F) of curing fluid to enter into the stack containing space 11 through the slits 4 between the vertical longitudinal pipes 2*c* prohibiting the flow (F) of curing fluid to enter the stack containing space 11 from underneath the stack.

During drying and/or curing, the pressure inside the chamber 1 increases and an outlet channel 5 guides a part of the curing fluid out of the chamber 1 into a capacitor (not shown) to lower the pressure inside the chamber 1.

FIG. 1 indicates the flow (F) of curing fluid during drying and/or curing. Even if the flow (F) is alternating during operation, the figure illustrates only one direction of the flow (F). As can be seen from FIG. 1 the flow (F) of curing fluid is concentrated (indicated by large arrows) when leaving the fan 7. When the flow (F) of curing fluid passes into the stack containing space 11, through the slits 4 formed by the heating element 2, the concentrated flow (F) is divided into a homogenously distributed flow (F) (indicated by small arrows) which passes through the gaps 16 between the planks 3' in one of the two partial stacks 3" before entering through slits 4 of another heating element 2 which contributes to maintain the homogeneous flow (F) when the flow (F) is entering the second partial stack 3". Before the flow (F) of curing fluid is leaving the stack containing space 11, it passes through the slits 4 of yet another heating element (2) which also contributes to maintain a homogeneous flow (F) within the stack containing space 11. Thereafter the flow (F) is concentrated again before passing through the fan 7.

As shown in FIG. 1 the upper horizontal pipe 2*a* of the heating element 2 is in contact with the fluid flow restrictor 6, thus guiding the flow of curing fluid through the slits 4 of the heating element 2.

FIGS. 2 and 3 are three dimensional views of an open apparatus of the exemplary embodiment of the present invention showing the arrangement of a plurality of fans 7 arranged in parallel inside openings in the wall 12. As can be seen from the figure the heating elements 2 are arranged along the side of the stack comprising space 11 covering the entire side surface of the stack 3 along the height $H_s$ and length $L_s$ thereof.

In another exemplary embodiment the apparatus may comprises only one heating element 2 arranged on the one side of the stack containing space, and the flow (F) of curing fluid may enter the stack containing space 11 before or after passing through the slits 4 of the heating element 2, depending on the direction of the flow (F). Due to the drop in pressure before the flow (F) enters through the slits 4, a homogeneously distributed flow (F) of curing fluid is obtained within the stack containing space 11 independently of the direction of the flow (F) of curing fluid.

Figure 5:
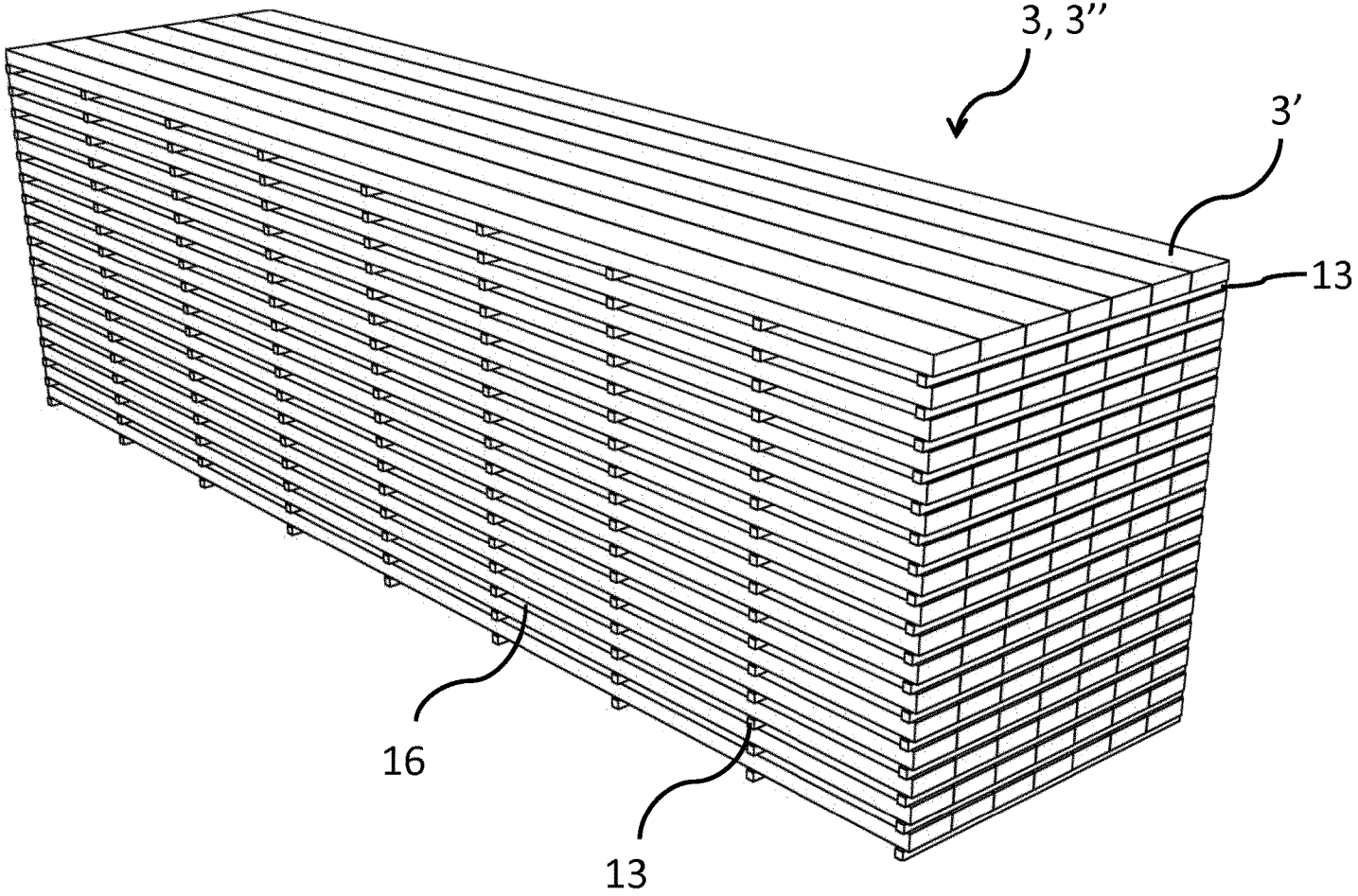
FIG. 5 shows a stack of wood.

FIG. 5 illustrates a stack 3 of wooden planks 3' wherein the planks 3' are separated by spacer elements 13 in the direction of the height $H_s$ thereby creating a gap 16 between the planks 3'. FIG. 5 may also illustrate one partial stack 3" of planks 3', since a stack 3 may comprise one or more partial stacks 3" of planks 3'. The gap 16 allows the flow (F) of curing fluid to pass therethrough during operation. If the stack 3 comprises one partial stack 3", the stack 3 and the partial stack 3" has the same size.

EXAMPLE OF A DRYING AND CURING PROCESS

This example describes drying and curing wherein the elongated material is wood pre-treated with an impregnating material such as a monomer or oligomer which polymerizes during curing. The drying and curing operate to produce polymer impregnated cured wood. The pre-treating method is known from for example WO 2011/144608 A1 and will not be described in further detail.

During drying and curing of wood comprising an impregnating solution, the increased temperature in the atmosphere inside the apparatus will result in removal of water (drying) and polymerization (curing) of the impregnating solution.

The pre-treated planks of wood 3' are arranged in layers of planks 3' uniformly separated in height $H_s$ by spacer elements 13 creating a gap 16 between the planks 3', thereby obtaining a partial stack 3". The stack 3 which may comprise one or more partial stacks 3" of planks 3' are placed inside the stack containing space 11 of the chamber 1 by passing through a door. The door is closed in a sealed manner before the drying and/or curing process is activated.

Before the drying or curing can be carried out, most of the oxygen inside the chamber 1 is removed. Oxygen inside the chamber 1 may otherwise react with volatile chemical compounds (VOCs) which are developed during drying and/or curing to cause an explosion inside the chamber 1.

The chamber 1 is therefore filled with an inert gas such as nitrogen or argon passing through an inlet channel (not shown in the figures) and the fluid inside the chamber 1 is removed through the outlet channel 5.

Thereafter the drying and curing process is achieved by circulating the curing fluid (F) in the chamber 1.

The flow (F) of the curing fluid is driven and circulated by at least one fan 7. By arranging a fluid flow restrictor 6 between the stack containing space 11 and the fan 7, the flow of curing fluid is guided into the stack containing space 11 through slits 4 in the heating element 2. The fan 7 may be arranged centrally above the fluid flow restrictor 6 to obtain an equal flow distance from the stack containing space 11 when the fan alternates the direction of the flow (F) of curing fluid.

The stack 3 of wood planks 3' are arranged on top of support elements 8, wherein the support elements 8 blocks the fluid flow (F) from entering inside the stack containing space 11 from underneath.

The flow (F) of curing fluid is forced through the slits 4 between the vertical elongated pipes 2*c* of the heating elements 2 into the stack containing space 11 indicated by arrows in FIG. 1. The bigger the arrows in the FIG. 1, the faster is the velocity of the flow (F) of the curing fluid. The heating elements 2 comprise hollow pipes 2*a-c* configured to receive and distribute a heating element fluid (for example steam) within the vertical and horizontal hollow longitudinal pipes 2*a-c*. The temperature of the curing fluid can be regulated by regulating the temperature of the heating element fluid entering the pipes 2*a-c* of the heating element 2. The curing fluid can thus obtain a desired temperature when passing through the slits 4 and the temperature of the curing fluid and the distribution of flow (F) becomes uniform/homogeneous within the stack containing space 11. This uniformly heated curing fluid passes into the stack 3 of wooden planks 3' and is being uniformly distributed through the gaps 16 established by the spacer elements 13. The wooden planks 3' inside the stack 3 are thereby uniformly dried by the curing fluid which vaporizes the water inside the wooden planks 3' and polymerizes the impregnating solution. The configuration of the apparatus results in that all the dried wooden planks 3' produced comprises a uniform amount of water and polymer regardless of their position inside the stack containing space 11.

As can be seen from FIG. 1-4, two parallel sets of heating elements 2 can be arranged centrally between two adjacent partial stacks 3" of planks 3'. Such an arrangement of heating elements 2 contributes to a uniform/homogeneous flow (F) and temperature of curing fluid through the entire passage inside the stack containing space 11. The flow (F) of curing fluid is subsequently guided through the fan(s) 7 to continue the drying and curing process. A small amount of curing fluid can be guided out of the chamber 1 through the outlet channel 5 when the atmosphere in the chamber 1 expands as the water from the planks evaporates.

To contribute to a homogeneous drying and curing of the wood inside the chamber 1 independently on the location of the wood, the fan 7 is alternating the direction of the flow (F) of curing fluid frequently during operation.

During drying and curing released resins and polymerizable components tend to deposit on the surfaces of the heating elements 2. When the polymers and/or resin stick onto the heating elements 2, they grow layers on the heating elements 2 which over time result in clogging of the slits between the elements 2. Thus, the growing of resins and or polymers on the heating elements 2 causes a major reduction in the heating effect from the elements 2 and the thicker the heating elements 2 become due to layers of polymers and/or resins stuck thereto, the less curing fluid passes through the slits 4 between them. This results in reduced heat transfer between heating elements 2 and the curing fluid, and consequently causes extended process times and an uneven flow (F) of curing fluid within the stack 3 of wood, giving products with uneven residual moisture contents.

Thus, to reduce the above-mentioned problems, the heating elements 2 are configured to comprise straight hollow longitudinal pipes (2*a-c*) having a smooth surface. The resins and polymers may therefore easily be scaling or flaking off the surface of the pipes (2*a-c*) and precipitate to the bottom of the chamber 1 during use, and/or can be easily removed from the surfaces of the pipes (2*a-c*) after use by cleaning with for example high pressure water or steam, or high pressure air.

Both during the drying and the curing process, liquid state resins originating from the wood are created as well as other residual liquid components, and combines to a so-called bottom condensate, comprising inter alia released water, resins and polymers, which fall down/precipitate to the bottom/floor 14 of the chamber 1. The gradient or sloping chamber floor 14 having a drain port 15 in or adjacent to the floor 14 provides continuous draining of the bottom condensate. The bottom condensate may be routed to a separation tank outside the chamber 1 that permits separation of the re-useable parts of condensate from unusable heavy density polymers.

To avoid the possibility of explosion, the electric fan motor 9 is arranged outside the chamber 1. Further, the moving parts of the shaft needing lubrication to function properly, are arranged inside an enclosing tube 10 of inert gas, and the top condensate comprising VOCs which tend to degrade the lubricants are hindered from entering the enclosing tube 10. The excess vapour is removed from the chamber 1 by routing it through the outlet channel 5 to condensers and tanks outside the chamber 1 for reuse in a mixing tank for new impregnation solution.

LIST OF REFERENCE NUMERALS/LETTERS

1 chamber
2 heating element
2*a,b* horizontal pipe
2*c* vertical pipe
3 stack
3' elongated wooden planks
3" partial stack
4 opening/slit
5 outlet channel
6 fluid flow restrictor
7 flow generating device
8 support element
9 motor
10 enclosing tube
11 stack containing space
12 fluid flow preventing wall
13 spacer elements
14 chamber floor
15 drain port
16 gap between the planks
F flow of curing fluid
$H_s$ height of a stack
$L_s$ length of a stack
$W_s$ width of a stack

The invention claimed is:

1. An apparatus for curing impregnated wood, wherein the apparatus comprises a chamber comprising:

a stack containing space for containing a plurality of elongated wood planks arranged in a stack of a height $H_s$, width $W_s$ and length $L_s$, a heating element for heating curing fluid arranged within or adjacent to the stack containing space, wherein the size and orientation of the heating element is configured such that the heating element extends along at least the height $H_s$ and the length Ls of the stack's surface area when the stack has been inserted into the stack containing space, a fan arranged outside the stack containing space and configured to generate a circulating flow of curing fluid within the chamber and a fluid flow restrictor arranged between the stack containing space and the fan, wherein the fluid flow restrictor is having a size and orientation extending over the entire surface area of the stack in the stack's length $L_s$ and width $W_s$ and/or the height $H_s$ and width $W_s$ when the stack (3) has been inserted into the stack containing space (11), wherein the fan and the fluid flow restrictor are further configured such that the circulating flow of curing fluid is guided through the heating element generating a homogeneously heated and distributed flow of curing fluid in the stack containing space, and wherein the apparatus further comprises at least one motor arranged outside the chamber, the at least one motor being configured to operate the fan via a connecting shaft, wherein a part of the shaft contained within the chamber is arranged within an enclosing tube that, during operation, contains an inert gas.

2. The apparatus according to claim 1, wherein the fluid flow restrictor is arranged between 0.1 and 50 cm from the stack, during use.

3. The apparatus according to claim 1, the fan is arranged within or adjacent to at least one fluid flow preventing wall, the at least one wall being configured to guide the flow of curing fluid fully through the fan.

4. The apparatus according to claim 1, wherein the chamber is comprising at least two heating elements, wherein at least two heating elements are arranged on the opposite side of the stack extending along at least the height $H_s$ and the length $L_s$ of the stack's surface area when the stack has been inserted into the stack containing space.

5. The apparatus according to claim 1, wherein heating elements are arranged between 0.1 and 50 cm from the stack during use.

6. The apparatus according to claim 1, wherein the chamber is comprising at least three heating elements, wherein at least two of the at least three heating elements are arranged on the opposite side of the stack extending along at least the height $H_s$ and the length $L_s$ of the stack's surface area when the stack has been inserted into the stack containing space, and at least one of the at least three heating elements is arranged in between the at least two opposite arranged heating elements.

7. The apparatus according to claim 1, wherein the heating element comprises a plurality of interconnected pipes for flow of heating element fluid therethrough, wherein the plurality of pipes are spaced apart, thereby forming a plurality of slits into which the circulating flow of curing fluid may pass through during operation.

8. The apparatus according to claim 1, wherein the heating element comprises a plurality of interconnected horizontal pipes and vertical pipes for flow of heating element fluid therethrough, wherein at least two horizontal pipes are spaced apart by the plurality of vertical pipes forming a plurality of slits into which the flow of curing fluid may pass through during operation.

9. The apparatus according to claim 8, wherein the number of vertical pipes exceeds the number of horizontal pipes by a factor of at least 2.

10. The apparatus according to claim 8, wherein the plurality of vertical pipes are equally or near equally spaced apart, and the plurality of horizontal pipes are equally or near equally spaced apart.

11. The apparatus according to claim 10, wherein each of the plurality of pipes are straight.

12. The apparatus according to claim 11, wherein each of the plurality of pipes has a smooth outer surface.

13. The apparatus according to claim 1, wherein the elongated wood planks, when installed within the stack containing space are being separated in height by spacer elements, thereby allowing the flow of curing fluid to circulate between the stacked layers of elongated wooden planks.

14. The apparatus according to claim 1, wherein the chamber further comprises a chamber floor at or adjacent to a base of the stack containing space intended to support the stack, wherein the chamber floor has a gradient allowing continuous drainage of deposits originating from the stack during operation.

15. The apparatus according to claim 14, wherein the chamber displays at least one drain port in or adjacent to the gradient chamber floor for continuously draining any deposits originating from the wood planks during operation.

16. The apparatus according to claim 1, wherein the end of the enclosing tube connected to the chamber wall of the chamber encloses at least one inert gas inlet allowing inlet of inert gas from outside the chamber into the enclosing tube and that the other end of the enclosing tube arranged adjacent to the fan has at least one outlet penetrating its enclosing tube wall, allowing outlet of inert gas through the enclosing tube.

17. A method for drying and/or curing impregnated wood in an apparatus according to claim 1, for obtaining a homogeneously heated and homogeneously distributed flow of curing fluid within the stack containing space comprising the flowing steps:

a) inserting the stack of wood planks inside the stack containing space of the chamber, b) sealing the chamber, c) activating the fan for producing a circulating flow of curing fluid inside the chamber and d) forcing the circulating flow of curing fluid to pass through the heating element.

18. The method according to claim 17, wherein the method further comprises the step of flushing the chamber with an inert gas prior to step c) to remove oxygen from the atmosphere inside the chamber.

19. The method according to claim 18, wherein the method further comprises the step of continuously draining deposits originating from the wooden planks during operation through at least one drain port.

20. The apparatus according to claim 1, wherein the fluid flow restrictor is arranged between 0.3 and 20 cm from the stack during use.

21. The apparatus according to claim 1, wherein the fluid flow restrictor is arranged between 0.5 and 5 cm from the stack during use.

22. The apparatus according to claim 1, wherein heating elements are arranged between 0.3 and 20 cm from the stack during use.

23. The apparatus according to claim 1, wherein heating elements are arranged between 0.5 and 5 cm from the stack.

* * * * *